US006823950B2

(12) United States Patent
von Eberstein, Jr. et al.

(10) Patent No.: US 6,823,950 B2
(45) Date of Patent: Nov. 30, 2004

(54) METHOD FOR FORMATION PRESSURE CONTROL WHILE DRILLING

(75) Inventors: William Henry von Eberstein, Jr., Slidell, LA (US); George Herbert Mayo, Toomsuba, MS (US); Mark Allen Weaver, Church Point, LA (US); Eric van Oort, Mandeville, LA (US); Ernest Benedict Kotara, Jr., Mandeville, LA (US)

(73) Assignee: Shell Oil Company, Houston, TX (US)

( * ) Notice: Subject to any disclaimer, the term of this patent is extended or adjusted under 35 U.S.C. 154(b) by 9 days.

(21) Appl. No.: 10/308,516

(22) Filed: Dec. 3, 2002

(65) Prior Publication Data

US 2003/0127230 A1 Jul. 10, 2003

Related U.S. Application Data

(60) Provisional application No. 60/337,009, filed on Dec. 3, 2001.

(51) Int. Cl.[7] ..... E21B 7/12; E21B 47/06

(52) U.S. Cl. ..... 175/5; 175/50; 166/250.1; 166/308.1; 166/337; 73/152.22

(58) Field of Search ..... 166/337, 336, 166/250.01, 250.02, 250.08, 250.1, 308.1; 175/5, 50; 73/152.39, 152.55, 152.51, 152.22

(56) References Cited

U.S. PATENT DOCUMENTS

| | | | | |
|---|---|---|---|---|
| 4,432,078 A | * | 2/1984 | Silverman | 367/37 |
| 4,577,689 A | | 3/1986 | Dotson | 166/250 |
| 4,749,038 A | * | 6/1988 | Shelley | 166/250.1 |
| 4,793,413 A | * | 12/1988 | Singh et al. | 166/250.1 |
| 5,050,674 A | * | 9/1991 | Soliman et al. | 166/250.1 |
| 5,180,020 A | | 1/1993 | Fuh et al. | |
| 5,207,282 A | | 5/1993 | Fuh et al. | |
| 6,234,250 B1 | | 5/2001 | Green et al. | |
| 6,364,015 B1 | * | 4/2002 | Upchurch | 166/250.1 |
| 6,705,398 B2 | * | 3/2004 | Weng | 166/250.1 |
| 2004/0050588 A1 | * | 3/2004 | Follini et al. | 175/50 |

FOREIGN PATENT DOCUMENTS

| | | | |
|---|---|---|---|
| EP | 456/424 A2 | 3/1991 | E21B/49/00 |
| WO | 98/42948 | 1/1998 | E21B/47/06 |

OTHER PUBLICATIONS

T. R. Bratton, I. M. Rezmer–Cooper, J. Desroches, Y. E. Gille, Q. Li, "How to Diagnose Drilling Induced Fractures in Wells Drilled with Oil–Based Muds with Real–Time Resistivity and Pressure Measurements" paper SPE/1ADC 67742. Mar. 2001.

C. Ward and R. Clark, "Anatomy of a Ballooning Borehole using PWD", in Overpressures in Petroleum Exploration; Workshop Proceedings, Pau, France, Apr. 1998.

O. A. Helstrup, M. K. Rahman, M. M. Hossain, S. S. Rahman, A Practical Method for Evaluating Effects of Fracture Charging and/or Ballooning When Drilling High–Pressure, High–Temperature (HPHT) Wells, paper SPE/1ADC 67780. Mar. 2001.

P. R. Ashley, "Well Control of an Influx From a Fracture Breathing Formation", paper IADC/SPE 62770. Sep. 2000.

(List continued on next page.)

*Primary Examiner*—David Bagnell
*Assistant Examiner*—Daniel P Stephenson

(57) ABSTRACT

A method for addressing the problem known as formation breathing occurring during the drilling of a subsea well in an earth formation in performing a series of leak off tests to determine the earth formation fracture propagation pressure and the earth formation fracture reopen pressure and maintaining the hydrostatic pressure on the earth formation in a range between the fracture reopen pressure and the fracture propagation pressure.

11 Claims, 4 Drawing Sheets

OTHER PUBLICATIONS

B. S. Aadnoy in "Modern Well Design", Appendix B, A.A. Balkema, Rotterdam, 1997.

J. U. Messenger in "Lost Circulation", (which includes Chapter 5, "Lost Circulation Materials and Techniques" pp. 35–93, PennWell Books, Tulsa, 1981.

N. Morita, A. D. Black, G.R. Fuh: "Theory of Lost Circulation Pressure", paper SPE 20409. Sep. 1990.

G. F. Fuh, N. Morita, P. A. Boyd, S. J. McGoffin: "A New Approach to Preventing Lost Circulation While Drilling", paper SPE 24599. Oct. 1992.

E. C. Onyia: "Experimental Data Anaylsis of Lost Circulation Problems During Drilling with Oil–Based Mud", SPE Drilling & Completion, Mar. 1994, pp. 25–31.

G. Altun, SPE, J. Langlinas, and A. T. Bourgoyne, Jr., Louisiana State University, "Application of a New Model to Analyze Leakoff Tests", pp. 759–770 Oct. 1999.

Evaluation Des Contraintes en Place a Parir D'essais De Leak Off pp. 779–790. Nov. 1995.

* cited by examiner

METHOD FOR FORMATION PRESSURE CONTROL WHILE DRILLING

This application claims the benefit of U.S. Provisional Application No. 60,337,009 filed Dec. 3. 2001.

FIELD OF THE INVENTION

The present invention relates to a method for drilling and controlling a well drilled in an earth formation. More specifically, it relates to a method for controlling the creation of formation fractures and the propagation of such fractures into the earth formation.

BACKGROUND OF THE INVENTION

The production of hydrocarbons, i.e., oil and gas, from earth formations generally entails the drilling of one or more wells in the formation. A common component in drilling operations is the use of drilling fluid or mud. The drilling fluid is generally comprised of a water-based, synthetic-based or oil-based transport fluid and barite and other additives. The fluid is pumped down the drill pipe and is used to cool the drill bit and to remove drilling cuttings from the borehole. The cuttings are entrained in the fluid and returned to the surface by way of the annulus formed between the drill string and the borehole formation wall or casing. The cuttings are removed and the drilling fluid is treated to maintain density or other properties and then re-injected down the drill string. The drilling fluid serves the additional purpose of controlling the downhole formation pressure. The weight and density of the mud and the resulting hydrostatic pressure impart a positive pressure on the formation. This prevents formation fluids under pressure from leaving the formation, entering the borehole and causing a well event, such as a gas kick, which can result in a catastrophic blowout (worst case). The on-site supervisor (e.g. foreman) and mud engineer select the desired fluid density and add weighting agents (e.g. barite, hematite) as required to achieve the desired pressure control. However, the hydrostatic pressure can result in the mud permeating into the formation resulting in damage to the formation. It can also affect logging operations designed to characterize the formation. The addition of certain materials to the mud can be used to create a coating or mudcake or filter cake on the borehole wall preventing damage to the formation and fluid leak-off. Ideally, the drilling fluid density is selected such that the hydrostatic force is greater than the formation pore pressure but less than the formation fracture gradient. If the hydrostatic pressure is greater than the fracture gradient, then the drilling fluid would invade the formation, creating fractures therein. This also would result in a significant loss of drilling fluid to the formation.

The wells are generally drilled in stages or intervals. At the end of each interval, casing is set in the hole to support the hole and secure it. A cementing shoe is set in the casing and cement is pumped down the casing and returns up the annulus, displacing the drilling fluid in the annulus. The cement then isolates the outside of the casing from the formation in a successful cementing job. The drill string is used to drill through the cementing shoe and drilling operations begin for the next interval. Based on the formation pore pressure, the formation fracture gradient and the equivalent mud weight at various depths, one determines the depth of the intervals. Once an interval is complete, a smaller diameter casing string is run through the larger string and the process of cementing and drill thru is repeated.

The drilling fluid density is characterized in terms of its equivalent static density (equivalent static density), which is the density of the fluid when not circulated. The equivalent static density is affected by fluid compressibility as a result of the hydrostatic head, as well as downhole pressure and temperature. The drilling fluid is further characterized in terms of its equivalent circulating density (equivalent circulating density), the dynamic density of the fluid during circulation and/or rotation of the drillpipe. In addition to the factors that effect the equivalent static density, equivalent circulating density takes into account frictional losses in density due to circulation and pipe rotation.

While the objective is to maintain the fluid density between the formation pore pressure and formation fracture gradient, it is not always achieved. In order to understand how the formation reacts with the drilling fluid under both equivalent static density and equivalent circulating density conditions, a driller will perform a leak-off test (LOT), sometimes known as a casing shoe test (CST) or formation integrity test (FIT). The LOT is typically performed after an interval of casing has been run and cemented and prior to drilling a new interval. In many instances, regulations require an LOT upon setting of a new casing shoe. Alternatively, a LOT may be performed in an openhole environment, i.e. a section of hole drilled but not yet secured by a cemented casing string.

The procedure for carrying out a LOT commences with drilling out any cement left in the casing shoe and drilling a short length of new hole, on the order of 5–10 feet. Drilling and circulation is terminated and the annular blow out preventers (BOP) are closed on the drillpipe to isolate the drill string from (a) the cemented casing and (b) the newly drilled formation section. Drilling fluid is pumped down hole at low rates on the order of 0.25–1.0 barrels per min (bpm) and pressure measurements are made at the surface and/or using downhole pressure sensors.

The reaction of the formation to the increased pressures is depicted in FIG. 1. The initial pressure profile is typically linear in nature and is attributable to the elastic deformation of the formation and the previously set casing as well as compression of the drilling fluid. As the pressure increases, the pressure response becomes non-linear. Presuming that the casing cement bond/seal and equipment pressure losses are not the cause for the deviation from linearity, it may be presumed that the point of non-linearity is the leak-off point or fracture opening point. This generally occurs when the tangential or hoop stress in the borehole exceeds the tensile strength of the formation. At this point, fractures are opened in the formation and the decrease in pressure can be attributed to the loss of fluid into the formation. Within this range, the fracture propagation is controlled, in that it requires additional pressure or energy to grow the formation fracture.

As pressure is increased further, the formation reaches a point where it breaks down. The fracture now continues to propagate without the need for any additional pressure or energy. The maximum pressure attained may be described as the unstable fracture growth pressure, whereas the pressure at which the fracture grows uncontrollably is described as the fracture propagation pressure. At this point, drilling fluid continues to be lost to the formation. When the pumping is stopped, the pressure will drop to a lower value known as the instantaneous shut-in pressure, at which point, fracture propagation will cease. The fractures will begin to close or deflate. This process can be accelerated by flowing drilling fluid back through the choke lines to decrease pressure. In FIG. 1, the pressure decline following instantaneous shut-in pressure is most probably due to increased frictional pressure or a decrease in fracture compliance during the fracture reduction/deflation. During this period drilling fluid flows back out of the formation into the borehole. The pressure continues to decrease steadily until it reaches a point where a rapid pressure drop is detected. This is characteristic of the mechanical closing of the fracture and is described as the fracture closure pressure, which is usually equated with the in-situ minimum horizontal formation stress. Though the fracture is described as "closed", it may still exhibit significant permeability as a result being propped open by released formation materials or as a result of mismatches in the fracture faces.

If a second LOT is performed, again exhibiting the initial linear buildup, then the fracture opening pressure for the second test may occur at a pressure lower than the initial fracture opening pressure. This is due to the fact that the initial formation tensile strength and tangential hoop strength may have been lost as a result of the LOT cycle, thereby lowering the re-opening pressure. As a result the fracture re-opening pressure approaches that of the fracture closure pressure. As pressure is increased the formation undergoes stable fracture propagation as exhibited by the non-linear response until it once again reaches the fracture propagation pressure, at which time the formation undergoes unstable fracture propagation. Even though additional amounts of mud may be added, the pressure does not increase past the second fracture propagation pressure. It is between this range that the present invention attempts to control the phenomenon known as fracture breathing or borehole ballooning.

Fracture breathing is the result of drilling fluid losses to the formation while drilling ahead, followed by drilling fluid returns after the circulation pumps are turned off, such as during a drill string connection, trip or flow check. Fracture breathing may be characterized in terms of the aforementioned pressures as follows. Prior to fracture breathing occurring the downhole equivalent static density or equivalent circulating density temporarily or permanently exceeds the fracture opening pressure, thereby initiating fractures. Alternatively, the equivalent static density or equivalent circulating density may temporarily exceed the fracture re-opening pressure, thereby re-opening pre-existing fractures. Drilling fluid losses start occurring, as the fluid is now providing hydrostatic pressure to propagate the fractures in a controlled manner. When the equivalent circulating density or equivalent static density falls below the formation closure pressure, formation breathing occurs and the drilling fluid is returned to the wellbore as the fractures close. Generally, this does not represent a problem and is part of the expected fluid gains and losses encountered in drilling operations (although the observed gains may be mistaken as a signature of a well kick as a result of under-balanced conditions). However, a more serious problem can occur when during drilling, the drilling fluid invasion results in exchange or swap-out with formation fluid or gas that resides in the fractures. When the breathing phenomenon takes place and the drilling fluid is returned to the borehole, the formation fluid or gas is likewise returned to the borehole with the drilling fluid. This can result in a well control issue. The gas influx effectively decreases the density of the drilling fluid, thereby further encouraging gas influx and generating additional pressures within the borehole. Uncontrolled influx of gas could lead to a major well control event including a blow out in a catastrophic situation. Major concerns are the inability to distinguish fracture breathing from a regular well kick situation and the well control implications associated with the exchange of formation fluid and gas for drilling fluid in breathing fractures.

Fracture breathing, in particular, fracture deflation can occur in a formation even where the drilling fluid pressure is in excess of the formation pore pressure. This is because the fracture closure pressure is usually higher than the fluid pressure (equivalent circulating density or equivalent static density) being maintained downhole. An increase in equivalent static density below the fracture closure pressure, as achieved in a well kill operation, will not result in better control of the breathing phenomenon. More commonly, it will exacerbate the problem, with the increased fluid pressure resulting in larger and more numerous fractures. This will result in larger volumes of drilling fluid being lost to the formation and ultimately returned to the borehole, together with the return of larger volumes of formation fluid or gas.

There are examples in literature where fracture breathing has been erroneously identified as a formation fluid influx as a result of the fluid pressure being under-balanced with respect to higher than expected formation pore pressure. Well kill operations utilizing high density fluid generally failed to produce the desired results, made the fracture breathing problem more difficult, and in some cases have resulted in the loss of a well. Thus, there exists a lack of methodology for dealing with formation breathing.

SUMMARY OF THE INVENTION

The present invention is directed to a method of formation pressure control which deals with the problem of fracture breathing. More specifically, the present invention is directed to the use of a formation pressure control method for use in a subsea drilling environment.

A series of leak off tests are performed to determine formation response to hydrostatic pressure applied by the drilling fluid. A fracture opening pressure is determined, as well as a fracture propagation pressure and fracture reopen pressure. During drilling operations, the borehole pressure is maintained between the fracture propagation pressure and the fracture closure pressure, thereby preventing ballooning. This is accomplished through the combined measurement of drilling fluid volumes, borehole pressures, and application hydrostatic pressure in a combination of drilling and choke fluids, as well as increases or decreases in drilling fluid pump pressures to maintain the formation pressure within the desired range.

DESCRIPTION OF THE DRAWINGS

A better understanding of the present invention may be had with reference to the Detailed Description of the Preferred Embodiment in conjunction with the Figures, of which.

DETAILED DESCRIPTION OF THE PREFERRED EMBODIMENT

The method of breathing fracture control requires maintaining a downhole pressure above the formation closure pressure and preferably below the fracture propagation pressure during all drilling and casing operations. Maintaining a pressure above the formation closure pressure will effectively prevent breathing fractures from deflating and returning to the annulus not only previously lost drilling mud but also swapped out formation fluid and/or gas. As a consequence, pressure is maintained in a range where fracture initiation as well as propagation of multiple fractures may occur. This means that continuous losses to the formation may occur using this method. It is desirable to maintain the pressure below the fracture propagation pressure such that only stable fracture propagation occurs. This will limit the extent of mud losses. In the event the downhole pressure exceeds the fracture propagation pressure, large drilling fluid volumes may be required to handle uncontrolled losses, such that costs may become excessive and/or drilling fluid logistics (mixing, supply, rigsite handling etc.) may become highly challenging.

Even when maintaining the pressure below the fracture propagation pressure, the possibility exists that high initial drilling fluid losses may occur. However, since the pressure is below that of the fracture propagation pressure, such that there is only controlled fracture propagation, the high initial losses are likely to decrease since additional hydraulic pressure would be required to further propagate any fractures in the formation. High initial losses in the practice of the present invention may occur where a certain number of fractures are initiated in a weak zone, are grown in a controlled fashion to a certain size, and then arrest with no new fractures forming.

Knowledge of downhole formation pressures, such as fracture propagation pressures, fracture closing pressure, fracture re-opening pressures is required to perform the method of the present invention. Where reliable formation pressure information is unavailable, a LOT test (preferably with a second fracture re-opening cycle) should be performed to characterize relevant downhole pressures including fracture opening pressure, fracture propagation pressure, fracture control pressure and fracture re-opening pressure.

As noted above, the method may result in increased drilling fluid losses. Accordingly, an adequate supply of drilling fluid, including mud additives, should be available at the rig site to deal with potentially heavy losses.

Figure 2:
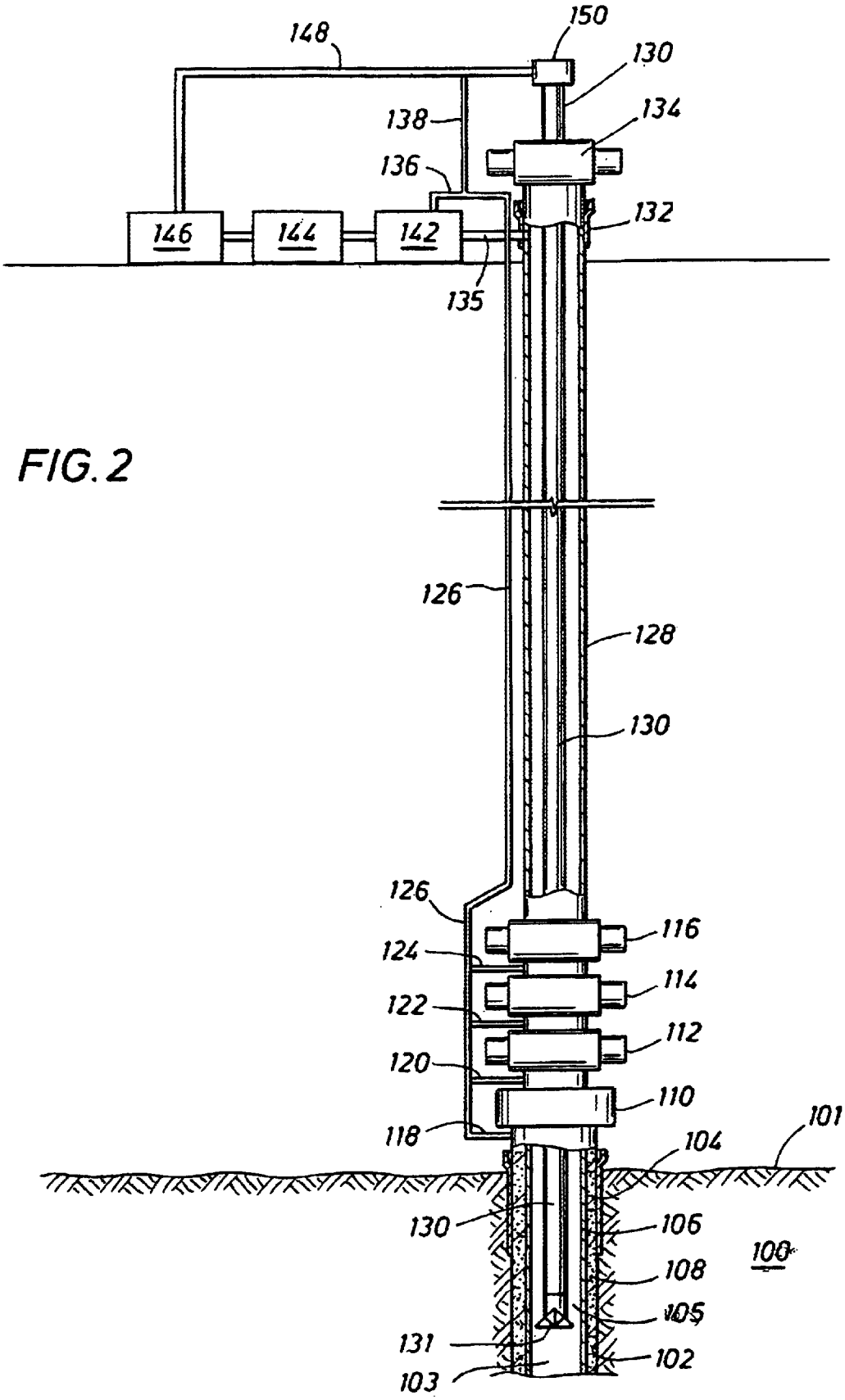
FIG. 2 is a simplified depiction of a subsea drilling environment as used in the present invention.

The use of the hydrostatic head attributable to drilling fluid in the BOP choke line may be used to elevate downhole pressure during static conditions (e.g. during connections). This method is useful only if the choke line is of significant length, such as on a deepwater well with subsea BOPs; it is not suited for on-shore wells or offshore wells with surface BOPs. A simplified subsea drilling environment is depicted in FIG. 2. A subsea formation 100 is shown below the sea floor 101, penetrated by a borehole 103, having a borehole wall 102. A drilling head 104 is installed in the sea floor 101, with casing 106 having been run and cement 108 in between the casing 106. An annular BOP 110 is connected to drilling head 104, and is further connected to three ram BOPs 112, 114 and 116. It will be appreciated that the problems associated with subsea drilling are significantly different from surface drilling in that there is no return annulus between the drilling string and the surface of the ocean. Therefore, an artificial annulus is created using a drilling riser 128. The drill string 130 extends from the surface, down through the drilling riser 128, the BOP stacks, 110, 112, 114 and 116 and into borehole 103. As with FIG. 2, drilling fluid (not shown) is pumped down through the drill string 130 and out drill bit 131 and returns up the annulus 105 formed between the drill string 130 and the borehole wall 102 or the casing 106.

The BOP stack may be used to close off the annulus 105, close off or shear the drill string 130 and/or riser 128 in the event of a well control event, such as a massive gas influx. Each of the BOPs 110, 112, 114, and 116 each have a valved choke line inlet, 118, 120, 122, and 124, respectively, attached to a common choke line 126 that traverses the distance from near ocean floor to the surface. A minimal BOP stack is located at the surface consisting of the drilling well head 132 and ram BOP 133. A conduit 135 is in fluid communications with the annulus 105 and the drilling fluid is returned to the shaker table 142, to remove drill cuttings from the drilling fluid. The drilling fluid is then forwarded to the mud pit 144, where the drilling fluid volume is measured, the fluid is conditioned by adding weighting materials or other additives. Mud pumps 146 pump the drilling fluid through conduit 148 and into the top of the drilling string 130 through connector 150. The choke line 126 is selectively connected to the supply conduit 148 or to the shaker table 142 by means of a valve (not shown). Thus, the amount of drilling fluid in choke line 126 may be selectively controlled. It will be appreciated that the simplified schematic of FIG. 2 does not include many aspects of a drilling system, including mud measurement systems, de-surger and pressure transducers typically used in measurement while drilling (MWD) and logging while drilling (LWD) operations.

In order to address the problems of formation breathing the choke line 126 is filled with weighted fluid such that:

$$D_{CHOKE}\times\rho_{CHOKE}+[D_{TVD}+D_{AIR}-D_{CHOKE}]\times\rho_{FLUID}+\Delta P_{COMPRESSIBILITY}>FCP \quad (1)$$

$$D_{CHOKE}\times\rho_{CHOKE}+[D_{TVD}+D_{AIR}-D_{CHOKE}]\times\rho_{FLUID}+\Delta P_{COMPRESSIBILITY}>FPP \quad (2)$$

where it is understood that the requirement in Eq. (1) is essential, whereas the requirement in Eq. (2) is merely desirable. The following definitions are used in Eqs.(1) and (2):

$D_{CHOKE}$ is the length of the choke line filled with weighted mud, in feet or meters;

$\rho_{CHOKE}$ is the density gradient of weighted mud in choke line, in psi/ft or Pa/m;

$D_{TVD}$ is the true vertical depth of the well, in feet of meters;

$D_{AIR}$ is the length of the air gap between main sea level and the rig floor, in feet or meters;

$\rho_{FLUID}$ is the density of drilling mud in the well, in psi/ft or Pa/m;

$\Delta P_{COMPRESSIBILITY}$ is the increase in downhole pressure due to mud compressibility, in psi or Pa;

FCP is the fracture closure pressure, in psi or Pa; and

FPP is the fracture propagation pressure, in psi or Pa

Alternatively application of additional hydraulic pressure to the choke line 126 through pump 142 and conduit 148, as opposed to relying on the hydrostatic head, to elevate downhole pressure may be used for on-shore wells or offshore wells with surface BOPs. The pressure applied on the choke line should fall within the range:

$$P_{CHOKE}+[D_{TVD}+D_{AIR}]\times\rho_{FLUID}+\Delta P_{COMPRESSIBILITY}>FCP \quad (3)$$

$$P_{CHOKE}+[D_{TVD}+D_{AIR}]\times\rho_{FLUID}+\Delta P_{COMPRESSIBILITY}<FPP \quad (4)$$

where it is understood that the requirement in Eq. (3) is essential, whereas the requirement in Eq. (4) is merely desirable. The following additional definitions are used in Eqs. (3) and (4):

$P_{CHOKE}$=pressure applied to the choke line, in psi or Pa;

The physical aspects of the best practice of the method requires that the drill string 130 be spaced such that the blow-out preventer (BOP) rams 112, 114 and 116 are preconfigured for every drill pipe connection. This procedure ensures that no tool-joints will be opposite the BOP rams when making connections. The mud pit 142 and return mud flow (not shown) should be maintained at a relatively stable condition, i.e., as to volume, fluid weight, etc. When a length of drill pipe (single or stand) has been drilled down and is ready for a connection, the drill string 130 should be positioned at the predetermined BOP space-out and the BOP slips set. The mud pumps 146 should then be shut down. As soon as pumps stop stroking, the pipe rams suitable for the size of drill pipe opposite the BOPs should be closed. A mud count (volume of closing fluid) should be performed. When the proper (expected) closing volume count is obtained, the lower fail-safe valves on the choke lines 118, 120, 122, and 124 should be opened. This will expose the additional hydraulic head of the weighted fluid or, alternatively, additional pressure in the choke line 126 to the annulus to elevate the downhole pressure (equivalent static density) to an amount equivalent to the equivalent circulating density that is maintained while drilling. This will ensure that the same downhole pressure is maintained in both static as well as dynamic situations. One should then observe and report the drilling fluid volume on the mini trip tank (also known as the stripping tank) 144.

If the drilling fluid volume in the hole either appears stable or there are additional losses of drilling fluid to the formation 100 (a verification that downhole pressure is indeed higher than the fracture closure pressure), the drill pipe joint connection should be completed and the drill pipe filled with drilling fluid. If, however, there is a gain in mini trip tank 144 volume (an indication that downhole pressure is below fracture closure pressure), consider pumping back (bull-heading)any gained volume into formation to prevent formation fluids or gas from contaminating the fluid in the annulus and coming to the surface.

Upon filling the drill pipe, the following sequence is performed: (1) the pipe rams are opened, (2) the lower choke fail-safe valves are opened and (3) the mud pumps 146 are brought online to pump drilling fluid commensurate with the drilling rate. The slips are then pulled and the pipe broken down quickly.

While drilling, the present invention requires maintaining an equivalent circulating density on the well through the manipulation of mud density and frictional pressure losses (influenced by e.g. mud flow rate, mud Theological properties, pipe rotation etc.) such that:

$$ECD=[D_{TVD}+D_{AIR}]\times\rho_{FLUID}+\Delta P_{COMPRESSIBILITY}+\Delta P_{FRICTION}>FCP \quad \text{Eq. (5)}$$

$$ECD=[D_{TVD}+D_{AIR}]\times\rho_{FLUID}+\Delta P_{COMPRESSIBILITY}+\Delta P_{FRICTION}<FPP \quad \text{Eq. (6)}$$

Where it is understood that the requirement in Eq. (5) is essential, whereas the requirement in Eq. (6) is merely desirable. The following additional definitions are used in Eqs.(5) and (6):

ECD is the equivalent circulating density, in psi or Pa; and $\Delta P_{FRICTION}$ is the frictional pressure losses due to mud circulation, in psi or Pa During operations utilizing weighted mud in the choke line, it is recommended that 5–10 bbls of the heavy mud be circulated into the choke line every hour. This will help prevent settling and plugging of the choke line.

The breathing fracture control method was experimentally verified in an ultra-deepwater sub-sea well drilled in the GOM. The pressure profiles for two penetrations through a weak zone that suffered from extensive in-situ faulting and fracturing showed that they supported a drilling margin of only 0.3 ppg (i.e. there was only a difference of 0.3 ppg between formation pore-pressure and formation fracture opening pressure, which equaled the with fractures that returned fracture re-opening pressure in this case). In the first penetration, extensive problems were experienced with gas being released to the annulus while breathing, a particularly severe problem on sub-sea wells where gas cannot be allowed into the riser. Conventional lost circulation control measures, e.g. pumping of LCM pills and use of squeezes, were unsuccessful in controlling the adverse breathing effects including the continuous influx and build-up of formation gas.

The section was plugged back and re-drilled using the breathing fracture control method. Formation pressures were as follows: pore pressure=15.6 ppg, fracture re-opening pressure=15.9 ppg, fracture propagation pressure=16.1 ppg. The breathing fracture control method required for downhole pressure to be maintained in the "window" between the fracture re-opening pressure and fracture propagation pressure, in this case between 15.9 ppg and 16.1 ppg. Initially, downhole pressure exceeded 16.1 ppg and excessive losses were noted. Downhole pressure was moved into the optimum window by adjustment of the mud density and using the annular pressure control method outlined below. Minimum losses were noted thereafter. Moreover, no fracture breathing problems were noted. The section was drilled and cased thereafter without problems.

Figure 1:
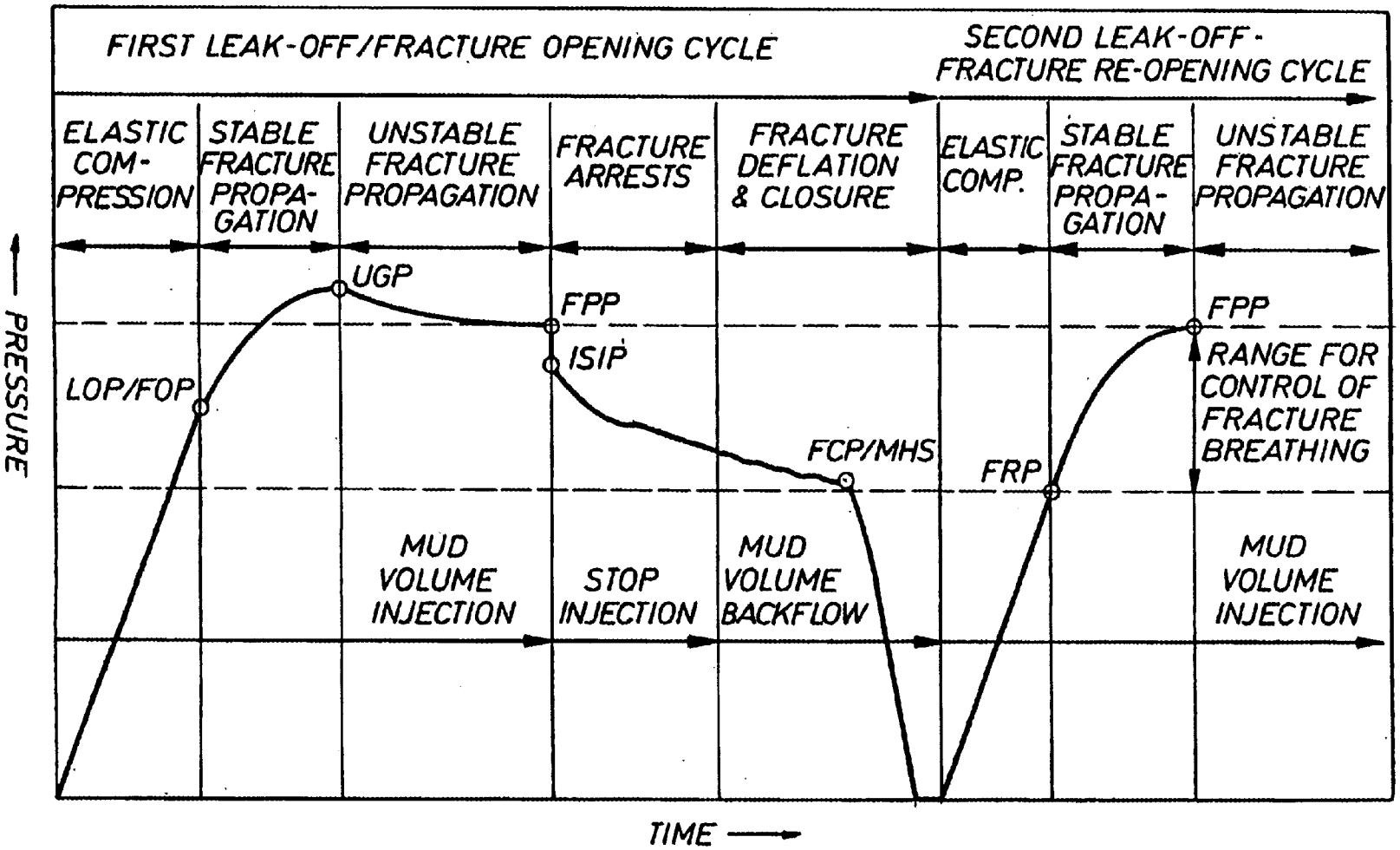
FIG. 1 is a graph setting forth the reaction of an earth formation in a drilling environment.
Figure 3A:
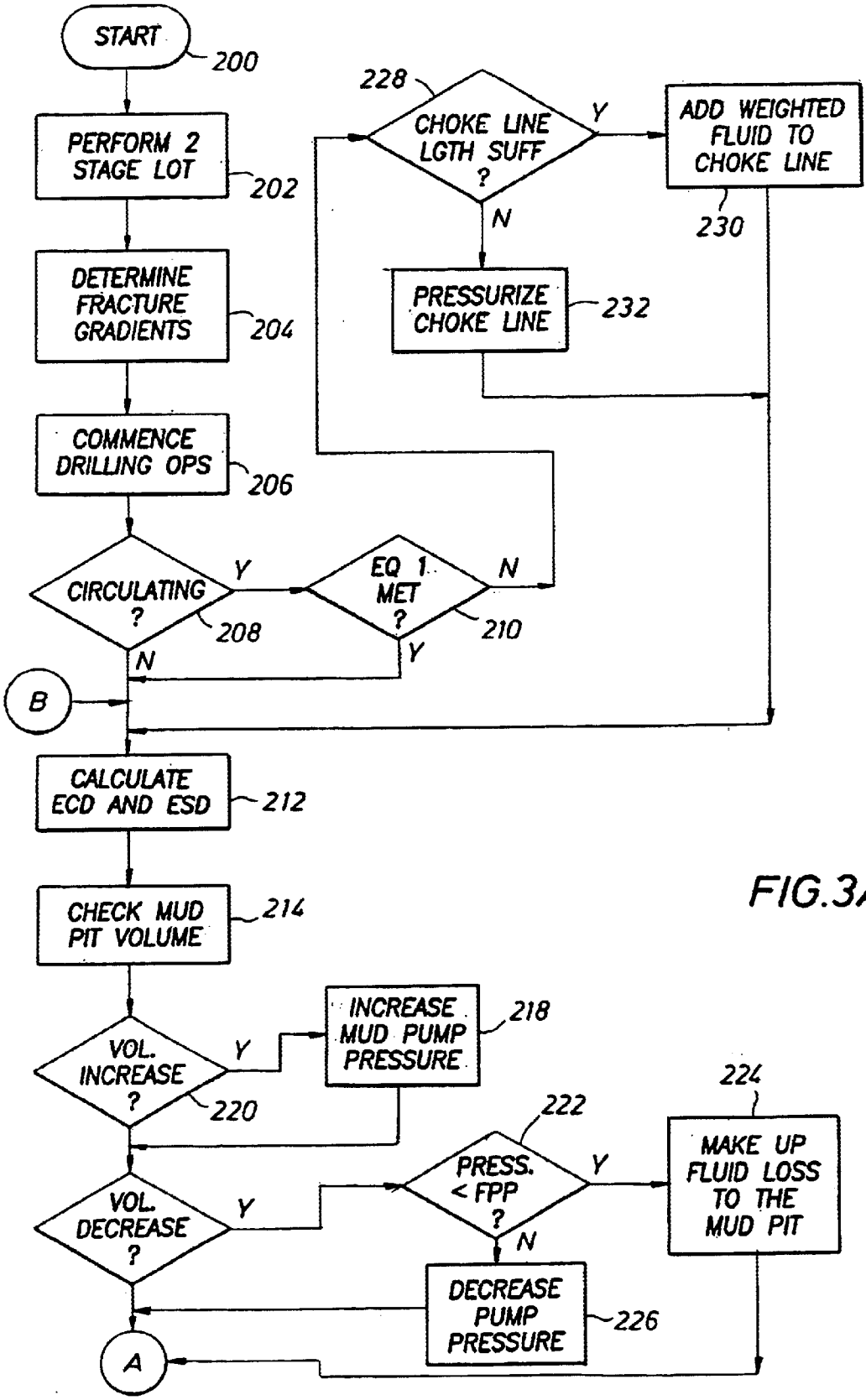
FIGS. 3A and 3B are a flowchart depicting the method of operation of the present invention.
Figure 3B:
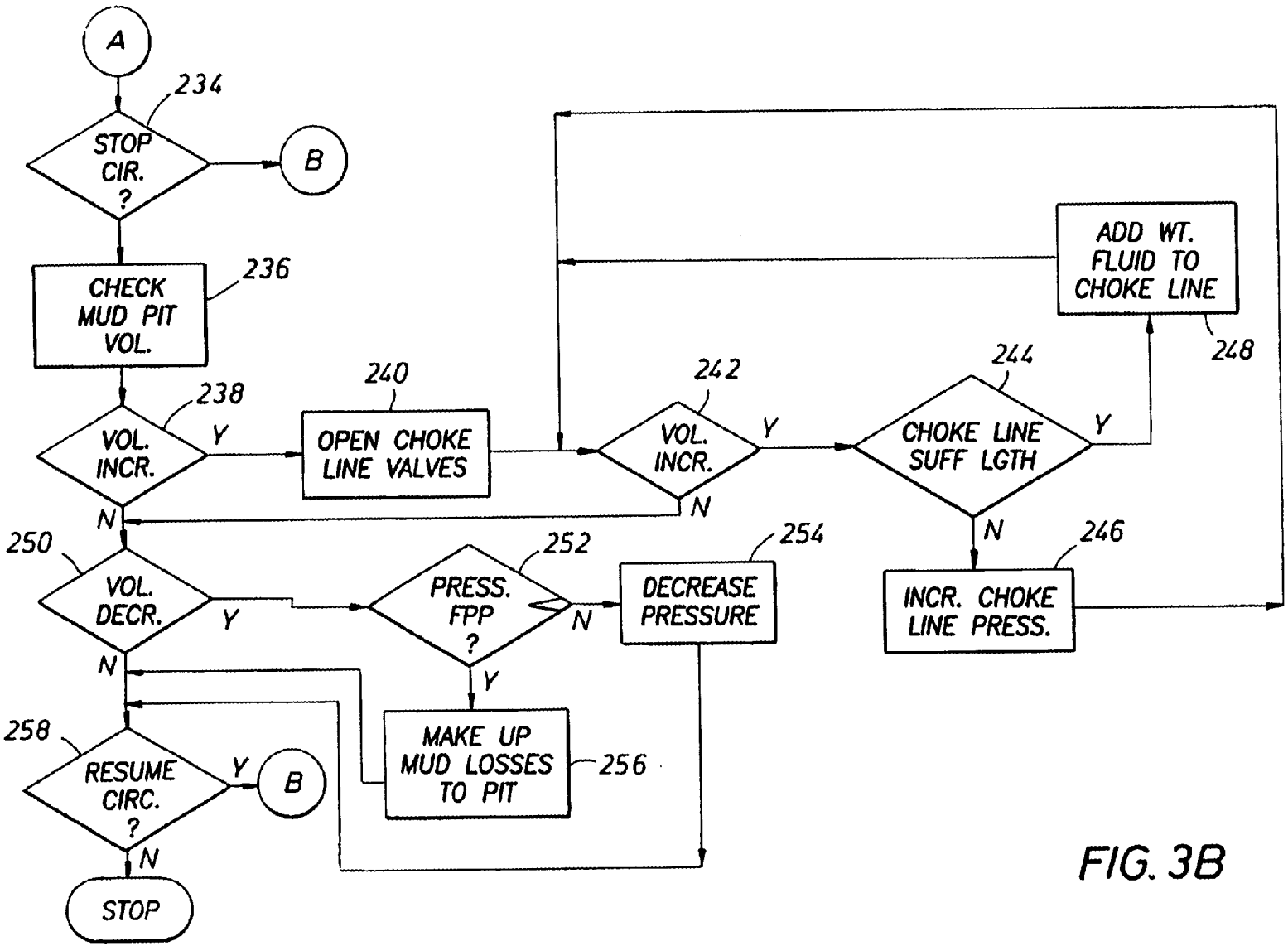

FIGS. 3A and 3B set forth the method of operation of the preferred embodiment of the present invention in terms as a flow chart. The procedure begins at step 200. Thereafter, the drilling operator performs the two stage LOT as described in FIG. 1. The driller then determines the fracture gradients, i.e., the Fracture Closure Pressure (FCP) and Facture Propagation Pressure (FPP) based on the information obtained in the LOT test. The driller then commences, or rather, resumes drilling operations in step 206. If the driller is circulating (step 208), is measured and the driller determines if the conditions of Eq. 1 are met. If the conditions of Eq. 1 are not met, the driller determines if the choke line is of sufficient length to meet Eq. 1 in step 228. If the choke line is of sufficient length such that the annular pressure is in excess of the formation closure pressure, then weighted fluid is added to the choke line is step 230 and the driller proceeds to step 212. Conversely, if it is determined in step 228 that the choke line is not of sufficient length such that the addition of weighted fluid would meet Eq. 1, then the choke line is pressurized. The driller then proceeds to step 212. In step 212, the driller determines the Equivalent Circulating Density (ECD) and the Equivalent Static Density (ESD). As the driller continues drilling operations the mud pit volume is checked in step 214. In step 216, a determination is made as to whether the amount of fluid in the mud pit has increased, which is indicative of fluid entering the borehole from the formation. If the mud volume has increased, the driller increases the mud pump pressure in step 218 and the process proceeds to step 220 where the driller determines if the mud pit volume has decreased. It should be noted that if the mud pit volume neither increases or decreases, the process proceeds to step 234. If in step 220, the driller determines that the mud pit volume has decreased, a determination is made in step 222 as to whether the annular pressure is less than the formation propagation pressure (FPP). If it is determined that the annular pressure is less than the FPP, which satisfies Eq. 2, then the driller simply makes up the fluid loss by adding additional mud to the pit in step 224 and the process proceeds to step 234. If the annular pressure is in excess of the FPP, this is indicative of fluid being lost to the formation and the driller decreases the mud pump pressure in step 226, with the process proceeding to step 234.

In step 234, decision is made whether to stop circulation, typically, when a new joint is being. If not, the process proceeds back to step 212. If circulation is stopped, the mud pit volume is checked in step 236. In step 238, a determination is made as to whether the mud pit volume is increasing. If it has increased, the process proceeds to step 240 in which the choke lines are opened, thereby relying on the hydrostatic head of the fluid in the choke lines. The process proceeds to step 242, in which the driller again determines whether the mud pit volume is continuing to increase, indicative of the fact that the opening of the choke lines has failed to stem the influx of formation fluid. Control then passes to step 244, in which the driller determines whether, based on the weight of the fluid presently in the choke lines, the choke line is of sufficient length that the addition of weighted fluid to the choke line would raise the annular pressure to a level in excess of the formation compaction pressure(FCP), thereby meeting the requirements of Eq. 1. If in step 244, the driller determines that the choke line is of sufficient length, the process proceeds to step 248 in which additional weighted fluid is added to the choke line. Thereafter, the process loops back to step 242. If the mud pit volume has stopped increasing the process proceeds to step 250. If it continues to increase the process again proceeds to step 244.

If in step 244, it is determined that the choke line is not of sufficient length, or the addition weighted fluid in step 248 did not stop the influx of formation fluid, the choke line pressure is increased by pump in step 246 and the process loops until such time as the mud pit volume cease to increase. The process then proceeds to step 250.

If there was no mud pit volume increase in step 238, the process proceeds to step 250, in which the driller determines whether the mud pit volume is decreasing. If yes, the driller determines if the annular pressure is less than the FCP in step 252. If the annular pressure is less than the FCP, the driller makes up fluid losses in step 256 and the process proceeds to step 258. If it is determined in step 252 that the annular pressure is greater than the FCP, the driller decreases mud the annular pressure in step 254. The process proceeds to step 258, in which the driller determines whether to resume circulation, if yes, the process proceeds to step 212. If not, the process of monitoring formation breathing stops.

In the above discussion, the person performing the process has generally been referred to as the driller, when in fact, it would comprise a number of people, including the drilling engineer, drilling hands, the mud engineer and various other persons involved in the drilling and well control process.

While the present invention has been described in terms of various embodiments, modifications in the apparatus and techniques described herein without departing from the concept of the present invention. It should be understood that the embodiments and techniques described in the foregoing are illustrative and are not intended to operate as a limitation on the scope of the invention.

We claim:

1. A method for controlling pressures during subsea well drilling operations in an earth formation, the steps comprising:

(a) providing a weighted drilling fluid system, said fluid being pumped through a drilling string in the earth formation, the drilling fluid providing a hydrostatic pressure on the earth formation and returning to up an annulus between a borehole created by the drilling string and the drilling, as well as a drilling riser, the drilling fluid being returned to atmospheric pressure, cleaned, measured and reused;

(b) performing a first leak off test by increasing pump pressure to determine a fracture opening pressure (FOP), an unstable fracture propagation pressure (UGP), a fracture propagation pressure (FPP), and a fracture closure pressure for the earth formation (FCP);

(c) performing a second leak off test by increasing pump pressure to determine a fracture reopen pressure; and (d) performing drilling operations while maintaining pressure exerted by said drilling fluid on the earth formation in a range between said fracture reopen pressure and said fracture propagation pressure.

2. The method of claim 1, wherein said fracture propagation pressure is a maximum pressure under which the earth formation will continue fracture propagation in response to increased pressure and said fracture reopen pressure is a pressure under which existing earth formation fractures will reopen in response to said pressure.

3. The method of claim 1, wherein the step of maintaining pressure exerted by said drilling fluid on the earth formation in a range between said fracture reopen pressure (FRP) and said fracture propagation pressure (FPP) further includes the steps of:

(a) monitoring pressure in said annulus;

(b) measuring drilling fluid volumes;

(c) providing a choke and kill system, including choke and kill lines and manifolds, during drilling operations and maintaining pressure applied on the earth formation such that $$D_{CHOKE}\times\rho_{CHOKE}+[D_{TVD}+D_{AIR}-D_{CHOKE}]\times\rho_{FLUID}+\Delta P_{COMPRESSIBILITY}>FCP \quad (1)$$

$$D_{CHOKE}\times\rho_{CHOKE}+[D_{TVD}+D_{AIR}-D_{CHOKE}]\times\rho_{FLUID}+\Delta P_{COMPRESSIBILITY}>FPP$$

where, $D_{CHOKE}$ is the length of the choke line filled with a weighted fluid; $\rho_{CHOKE}$ is the density gradient of said weighted fluid in said choke line; $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility.

4. The method of claim 3, further including the step of determining an equivalent circulating density (ECD) for said drilling fluid, such that $$ECD=[D_{TVD}+D_{AIR}]\times\rho_{FLUID}+\Delta P_{COMPRESSIBILITY}+\Delta P_{FRICTION}>FCP$$

$$ECD=[D_{TVD}+D_{AIR}]\times\rho_{FLUID}+\Delta P_{COMPRESSIBILITY}+\Delta P_{FRICTION}<FPP$$

where $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility; and $\Delta P_{FRICTION}$ is the frictional pressure losses due to drilling fluid circulation.

5. The method of claim 1, wherein the step of maintaining pressure exerted by said drilling fluid on the earth formation in a range between said fracture reopen pressure (FRP) and said fracture propagation pressure (FPP) further includes the steps of:

(a) monitoring pressure in said annulus;

(b) measuring drilling fluid volumes;

(c) providing a choke and kill system, including choke and kill lines and manifolds, during drilling operations and maintaining pressure applied on the earth formation such that $$P_{CHOKE}+[D_{TVD}+D_{AIR}]\times\rho_{FLUID}+\Delta P_{COMPRESSIBILITY}>FCP \quad (3)$$

$$P_{CHOKE}+[D_{TVD}+D_{AIR}]\times\rho_{FLUID}+\Delta P_{COMPRESSIBILITY}<FPP \quad (4)$$

where $P_{CHOKE}$=pressure applied to the choke line; $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility.

6. The method of claim 4, further including the step of determining an equivalent circulating density (ECD) for said drilling fluid, such that $$ECD=[D_{TVD}+D_{AIR}]\times\rho_{FLUID}+\Delta P_{COMPRESSIBILITY}+\Delta P_{FRICTION}>FCP$$

$$ECD=[D_{TVD}+D_{AIR}]\times\rho_{FLUID}+\Delta P_{COMPRESSIBILITY}+\Delta P_{FRICTION}<FPP$$

where $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility; and $\Delta P_{FRICTION}$ is the frictional pressure losses due to drilling fluid circulation.

7. The method of claim 1, further including the step of determining an equivalent circulating density (ECD) for said drilling fluid, such that $$ECD=[D_{TVD}+D_{AIR}]\times\rho_{FLUID}+\Delta P_{COMPRESSIBILITY}+\Delta P_{FRICTION}>FCP$$

$$ECD=[D_{TVD}+D_{AIR}]\times\rho_{FLUID}+\Delta P_{COMPRESSIBILITY}+\Delta P_{FRICTION}<FPP$$

where $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility; and $\Delta P_{FRICTION}$ is the frictional pressure losses due to drilling fluid circulation.

8. A method for maintaining well pressure control during drilling operations in a subsea drilling environment, the steps comprising:

(a) providing a weighted drilling fluid system for use in a subsea environment, including a subsea blowout preventor stack, choke and kill systems and drilling riser;

(b) performing a series of leak off tests by increasing pump pressure to determine a fracture propagation pressure (FPP), and a fracture closure pressure for the earth formation (FCP)and a fracture reopen pressure (FRP); and (c) performing drilling operations while maintaining pressure exerted by said drilling fluid on the earth formation in a range between said fracture reopen pressure and said fracture propagation pressure.

9. The method of claim 8, wherein the step of maintaining pressure exerted by said drilling fluid on the earth formation in a range between said fracture reopen pressure (FRP) and said fracture propagation pressure (FPP) further includes the steps of:

(a) monitoring pressure in said annulus;

(b) measuring drilling fluid volumes;

(c) providing a choke and kill system, including choke and kill lines and manifolds, during drilling operations and maintaining pressure applied on the earth formation such that $$D_{CHOKE}\times\rho_{CHOKE}+[D_{TVD}+D_{AIR}-D_{CHOKE}]\times\rho_{FLUID}+\Delta P_{COMPRESSIBILITY}>FCP \quad (1)$$

$$D_{CHOKE}\times\rho_{CHOKE}+[D_{TVD}+D_{AIR}-D_{CHOKE}]\times\rho_{FLUID}+\Delta P_{COMPRESSIBILITY}>FPP$$

where, $D_{CHOKE}$ is the length of the choke line filled with a weighted fluid; $\rho_{CHOKE}$ is the density gradient of said weighted fluid in said choke line; $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility.

10. The method of claim 8, wherein the step of maintaining pressure exerted by said drilling fluid on the earth formation in a range between said fracture reopen pressure (FRP) and said fracture propagation pressure (FPP) further includes the steps of:

(a) monitoring pressure in said annulus;

(b) measuring drilling fluid volumes;

(c) maintaining pressure applied on the earth formation such that $$P_{CHOKE}+[D_{TVD}+D_{AIR}]\times\rho_{FLUID}+\Delta P_{COMPRESSIBILITY}>FCP \quad (3)$$

$$P_{CHOKE}+[D_{TVD}+D_{AIR}]\times\rho_{FLUID}+\Delta P_{COMPRESSIBILITY}<FPP \quad (4)$$

where $P_{CHOKE}$ =pressure applied to the choke line; $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility.

11. The method of claim 8, further including the step of determining an equivalent circulating density (ECD) for said drilling fluid, such that $$ECD=[D_{TVD}+D_{AIR}]\times\rho_{FLUID}+\Delta P_{COMPRESSIBILITY}+\Delta P_{FRICTION}>FCP$$

$$ECD=[D_{TVD}+D_{AIR}]\times\rho_{FLUID}+\Delta P_{COMPRESSIBILITY}+\Delta P_{FRICTION}<FPP$$

where $D_{TVD}$ is true vertical depth of the well; $D_{AIR}$ is a distance between sea level and a rig floor supporting drilling operations; $\rho_{FLUID}$ is drilling fluid density in the well; and $\Delta P_{COMPRESSIBILITY}$ is downhole pressure increase attributable due to drilling fluid compressibility; and $\Delta P_{FRICTION}$ is the frictional pressure losses due to drilling fluid circulation.

* * * * *